US005477578A

United States Patent [19]

Duncan et al.

[11] Patent Number: 5,477,578

[45] Date of Patent: Dec. 26, 1995

[54] MACHINES FOR SCRUBBING OR FINISHING FLOOR SURFACES

[75] Inventors: Christopher R. Duncan, Chilworthy; Michael E. Gailes, Hooke, both of United Kingdom

[73] Assignee: Numatic International Limited, Surrey, England

[21] Appl. No.: 256,810

[22] PCT Filed: Jan. 20, 1993

[86] PCT No.: PCT/GB93/00118

§ 371 Date: Nov. 14, 1994

§ 102(e) Date: Nov. 14, 1994

[87] PCT Pub. No.: WO93/14684

PCT Pub. Date: Aug. 5, 1993

[30] Foreign Application Priority Data

Jan. 23, 1992 [GB] United Kingdom ..... 9201490

[51] Int. Cl.[6] ..... A47L 11/293; A47L 11/162

[52] U.S. Cl. ..... 15/47.1; 15/320; 15/385; 451/353

[58] Field of Search ..... 15/49.1, 50.1, 15/50.2, 50.3, 52.1, 52.2, 98, 320, 385; 299/41; 451/351, 352, 353

[56] References Cited

FOREIGN PATENT DOCUMENTS

| | | | |
|---|---|---|---|
| 1094945 | 12/1960 | Germany | 15/49.1 |
| 219092 | 5/1942 | Switzerland | 15/49.1 |
| 0931395 | 5/1982 | U.S.S.R. | 15/49.1 |

*Primary Examiner*—Edward L. Roberts, Jr.

*Attorney, Agent, or Firm*—Edwin E. Greigg; Ronald E. Greigg

[57] ABSTRACT

The invention relates to a machine having a carriage for movement on a floor surface. The carriage has structure for rocking the carriage with respect to a floor surface. A workhead assembly is pivotably mounted on the carriage for movement between a first working position and a second rest position. A biasing structure acts on the workhead assembly to move the workhead assembly from one of the positions to the other. Rocking of the carriage allows the workhead assembly to move under influence of the biasing structure from one position to the other position.

11 Claims, 4 Drawing Sheets

MACHINES FOR SCRUBBING OR FINISHING FLOOR SURFACES

The present invention relates to a machine for scrubbing or finishing a floor surface and has particular reference to such a machine of the kind hereinafter referred to as "the kind described" which comprises carriage means adapted for translational movement over a floor surface, a work head and motor means which is carried by the said carriage means and is arranged in use to drive the said work head.

The said work head may include a brush or pad carrier which is provided with means for securing a brush or pad thereto. The said motor means may include a rotary output shaft which is adapted to carry the said brush or pad carrier and to maintain it in working contact with the said floor surface. The said motor means may be carried on an upper surface of the carriage such that the said rotary output shaft extends downwardly through a hole formed in the carriage to carry the said pad carrier in coaxial relation therewith at the lower end of the shaft.

The carriage may be provided with an upstanding handle at a rear end thereof, whereby, in use, an operator moves the machine over a floor surface whilst the motor means drives the said work head at a high speed to scrub, polish or burnish the floor surface. The carriage may also include a pair of rear transit wheels which are mounted on an axle towards the rear of the carriage. Once the scrubbing or finishing operation is finished, the motor is switched off and the machine can be rocked backwards onto its rear transit wheels to lift the work head away from the floor surface. The machine can then be pushed by the operator on the said transit wheels to another location where it is required or for storage.

It will be appreciated that the motor is generally heavy, and lifting the motor and work head away from the floor and transporting the machine in such a position requires considerable physical effort. Moreover, although the weight of the machine is supported on the work head whilst in use, it is undesirable to store the machine in such a position because the weight of the machine will tend to deform the said brush or pad. In use, the motor drives the work head at a high speed, and such deformation of the brush or pad causes the machine to run out of balance frequently resulting in an unacceptable amount of vibration. In the machines, currently available in the marketplace it is desirable to remove the pad from the pad carrier after using the machine and to re-fit the brush when the machine is next required.

In order to remove the pad, however, the machine must be tilted on its rear wheels or turned onto its side whilst the operator removes the pad. The weight and bulk of the machine render this task somewhat onerous and there is, therefore, a requirement for a floor scrubbing or finishing machine which permits of easy removal and replacement of the pad or brush and which provides improved means for transporting the machine from one position to another with the pad disengaged from the floor surface.

According to one aspect of the present invention there is provided a machine of the kind described characterised by:

rocking means for rocking said carriage with respect to said surface;

workhead pivot means for causing or allowing said workhead to be movable between a first working position and a second rest position, and bias means acting on said workhead to move the workhead from one of said of positions to the other; the arrangement being such that rocking said carriage on its rocking means, causes or allows the workhead to move under the influence of said bias from the said one position to the said other position.

The said bias means may comprise a spring which is arranged to act between the workhead and the carriage. The said spring may be a compression spring or a tension spring.

In another embodiment of the present invention, the carriage means includes a brush housing. The brush housing may include an annular upper wall and a cylindrical skirt which depends from the periphery of the said annular wall; the brush or pad holder being arranged for rotation substantially coaxially within the housing. The motor means may be carried on the upper surface of the housing such that the said output shaft extends coaxially downwardly through the central hole of the annular wall. The brush housing and the motor means may be coupled in driving relationship with the workhead to be moveable therewith as the latter moves between said first and second positions. The weight of the workhead/brush housing/motor means assembly may be distributed assymmetrically of the pivot means when the workhead is in the said one position thereby to provide the said bias means; the arrangement being such that rocking the carriage on its rocking means allows the said workhead assembly to move from said one position to the said other position under the influence of gravity.

In the work position, the workhead assembly may be oriented such that the upper surface of the brush housing is generally horizontal with the workhead in working contact with the floor surface. In the said rest position, the brush or pad carrier may be oriented generally transverse the plane of the floor surface. Preferably, the workhead assembly includes means for supporting the assembly in the rest position, which supporting means may comprise one or more casters which are arranged to contact the floor surface when the workhead is in its rest position. According to a particularly preferred embodiment of the invention, the workhead assembly comprises two casters which are fastened to the external surface of the brush housing.

The upper surface of the brush housing may be provided with means for pivotting the workhead assembly relative to the carriage means. Said pivot means may include two spaced, upstanding brackets which are secured to the said upper surface towards the periphery thereof; the brackets being arranged diametrically opposite one another so that a through bore in each bracket together define the said pivot axis.

The carriage means may comprise two horizontally spaced chassis members which carry pivot means for the workhead assembly. Preferably, the pivot brackets on the brush housing are attached one to each arm on a horizontal axis generally transverse the fore-aft direction of the carriage such that the workhead assembly can pivot between its work position and its rest position in which latter position the pad carrier is disposed forwardly of the carriage.

The handle may be used to rock the carriage with respect to the floor surface. In accordance with a particular aspect of the present invention, the said rear wheels constitute the rocking means, and the carriage may be rocked forwards and backwards on the said rear wheels. In some embodiments of the present invention, rocking the carriage backwards on the rocking means may allow the workhead assembly to move under the influence of the said bias means from its work position to its rest position in which it is supported on the said casters of the brush housing. The machine can then be moved to and from the floor surface to be treated on said casters and the rear wheels.

The bias means may act to move the workhead from the said one position to the said other position in which latter position the workhead assembly is disposed over-center with respect to the pivot axis and the point of contact between the casters and the floor surface, whereby the reaction at the said casters exerts a moment of force about the pivot axis, which moment acts to retain the workhead assembly in the said other position and thereby allows the machine to be transported on its transit wheels and casters without the workhead returning to the one position. It will be appreciated, however, that the workhead may be pivoted with releasable locking or retaining means in a manner known to a man skilled in the art to retain the workhead in its rest position.

According to one aspect of the present invention, the workhead assembly comprises a counterweight which is fastened to the workhead assembly and is offset from the pivot axis when the assembly is in its work position such that weight of the workhead assembly is distributed assymmetrically with respect to the pivot. When the machine is rocked backwards on its rear wheels, the counterweight causes the workhead assembly to pivot about its axis from its work position to its rest position.

According to a further aspect of the present invention there is provided a machine for cleaning or polishing a floor surface, which machine comprises carriage means adapted for translational movement on a floor surface;

a receptacle for collecting liquid, which receptacle is carried on said carriage;

a chamber which is carried on said carriage means and communicates with the said receptacle;

a suction pump which communicates with said chamber; and a conduit which communicates with the chamber and has an inlet at an end remote from said chamber, which inlet is disposed juxtaposed said floor surface;

the arrangement being such that operation of said suction pump causes a reduction of pressure in the said chamber which causes liquid at the floor surface to enter into said conduit at the inlet and to move along the said conduit into said chamber where it falls under the influence of gravity into said liquid collecting receptacle.

The liquid collecting receptacle may be a box-like structure having a base and integrally moulded upstanding front, rear and side walls. The liquid collecting receptacle may be open at its upper end, which opening may be surrounded by a peripheral flange having a smooth upper surface.

The receptacle may have a volume of several tens of liters. It will be appreciated, therefore, that when full, the receptacle may have a weight of the order of tens of kilograms. According to a particularly preferred embodiment, the machine includes two liquid collecting receptacles which are shaped to be carried on the carriage one contiguous the other such that the upper surface of each liquid collecting receptacle is continuous with the upper surface of the other receptacle. This has the advantage that each receptacle contains about a half of the total volume of the liquid collected by the machine, and the receptacles can be removed separately from the machine, thereby facilitating the removal, carrying and emptying of the receptacle when they are full or nearly full.

The chamber may be a box-like structure having a base and integrally moulded upstanding side, front and rear walls and a top wall. Preferably, the chamber is arranged to be seated on the upper surface of the liquid collecting receptacle(s). The base of the chamber may have one or more holes formed therein. The bottom surface of the base of the chamber may be smooth to mate with the upper surface of the liquid collecting receptacle, and one or both of the chamber and the liquid collecting receptacle may be provided with a sealing material which is arranged to interpose between the liquid collecting receptacle and the chamber.

Preferably, the openings in the base of the chamber correspond to the openings in the liquid collecting receptacles.

The chamber may also include a collar which depends from the periphery of each hole formed in the base of chamber. When the chamber is seated on the base of the liquid collecting receptacle, the collar may extend downwardly through the hole formed in the top of the liquid collecting receptacle. The chamber may be provided with an inlet boss and an outlet boss. The outlet boss may be connected to a hose which communicates with the said suction pump.

The inlet boss may be connected to the said conduit. The hose and/or conduit are preferably formed from a flexible pipe of circular cross section having circumferential strengthening ribs. Preferably, the chamber may be provided with two inlet bosses, and the said conduit comprises two hoses which are connected to the said inlet bosses; each hose being connected remote from the chamber to the said nozzle.

Preferably, the inlet boss is formed in the chamber towards the base thereof, and the outlet boss is disposed towards the top of the chamber. In accordance with such arrangement, liquid entering into the chamber at the inlet boss(es) falls under gravity to the liquid collecting receptacle and can not enter into the outlet.

The suction pump may be carried on the carriage and is preferably, located in the vicinity of or over the rear wheels. The machine may further include a liquid reservoir for containing a detergent solution or liquid polish. Preferably, the reservoir comprises a moulded box-like structure having integral bottom, front, back, side and top walls. The reservoir may have an outlet which is connected to a conduit which terminates juxtaposed the floor surface. According to one embodiment of the invention, the conduit terminates inside the brush housing juxtaposed the brush holder. The reservoir may have a fluid inlet and a suitable closure therefor. Preferably, the reservoir is adapted to support the liquid collecting receptacle; and in a preferred embodiment of the invention, the upper wall of the reservoir is shaped to mate with the shaped bottom wall of the liquid collecting receptacle.

According to a particular aspect of the present invention, the chamber may be hinged to the machine handle such that the chamber can be rotated between a closed position in which the chamber is seated on the liquid receptacle and an open position in which the chamber is lifted away from the said liquid collecting receptacle. When the chamber is in the open position, the liquid collecting receptacle(s) may be lifted away from the liquid reservoir for emptying.

The reservoir, liquid collecting receptacle(s) and the chamber may be moulded from suitable thermo-plastic material known to a man skilled in the art e.g. polypropylene. Preferably, at least one of the walls of the chamber and/or liquid collecting receptacle is transparent to allow inspection of the contents of the liquid collecting receptacle thereby to determine when the same is full and needs emptying.

Following is a description by way of example only and with reference to the accompanying drawings of methods of carrying the present invention into effect:

Figure 1:
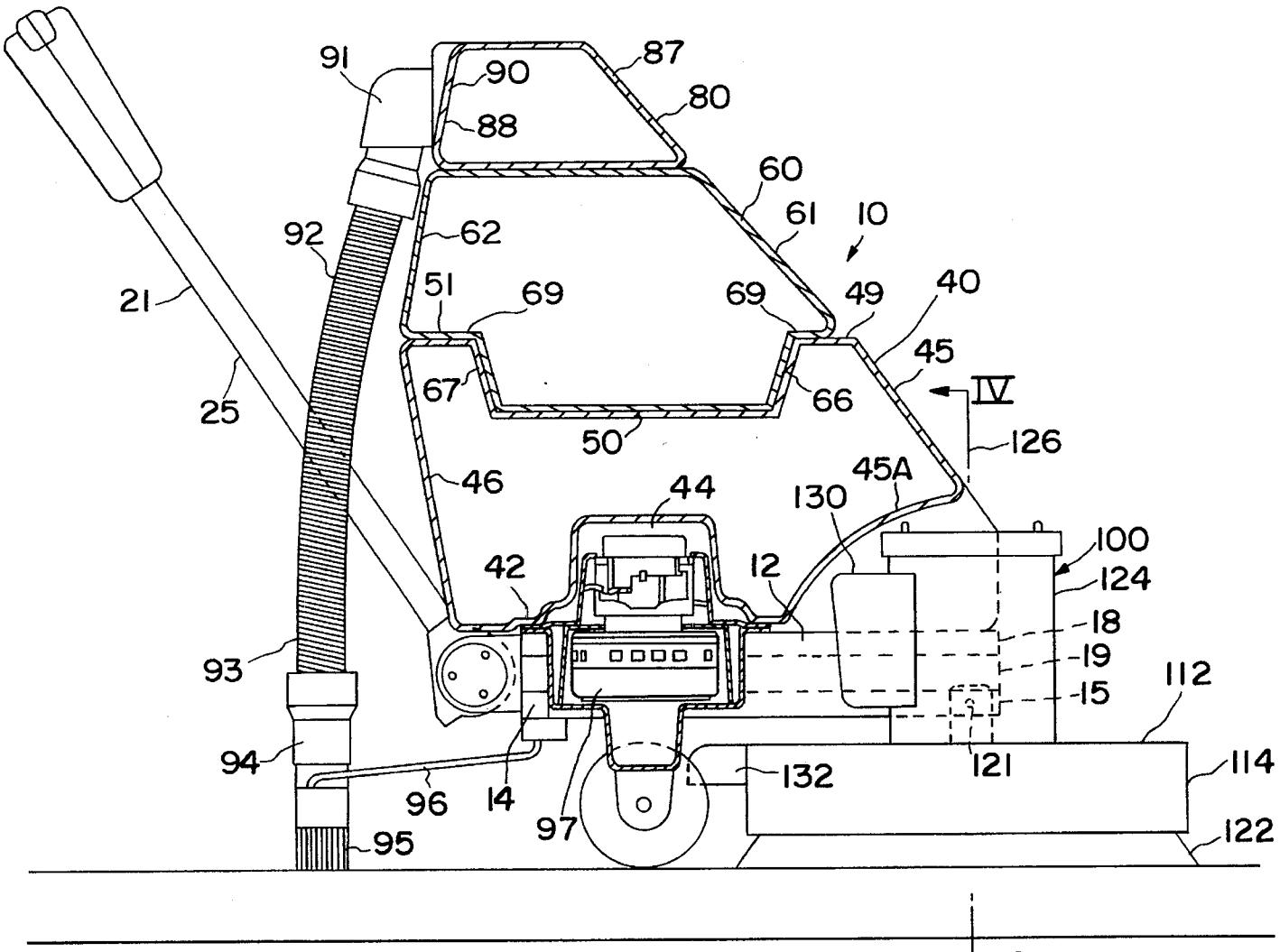
FIG. 1 is a schematic side view (partly in section) of a machine in accordance with the present invention.

Referring to FIG. 1, a machine (10) for scrubbing or finishing a floor surface includes a carriage (12) which comprises two horizontally spaced apart forwardly chassis members (18, 19).

The carriage (12) is supported towards its rear end (14) on two spaced apart transit wheels (16) each of which is mounted for rotation on an axle (17) which latter extends transversely of the members (18, 19). The said carriage (12) at it front end (15) carries a workhead assembly (100 ) which is pivotaly mounted between said members (18, 19) about a horizontal axis (117) which is arranged substantially at right angles to the fore-aft direction of the carriage (12).

Assembly (100) includes a brush housing (110) which comprises an annulus (112) having a depending cylindrical skirt (114); annulus (112) carries a motor (124), the housing of which is secured to the upper surface of said annulus (112) so that the output shaft of the motor (not shown) extends coaxially downwardly through the central hole of annulus (112). The said output shaft is fitted at it lower end with a discoidal pad carrier (also not shown) which is arranged to rotate coaxially within said housing (110). The pad carrier has a generally circular bottom surface which is provided with means for releasably fastening thereto a circular brush or pad unit (122) such that the lower end of said brush (122) extends downwardly from the housing (110) and, as shown in FIG. 1, into working contact with the surface on which the machine stands.

Motor (124) carries a counterweight (130) which is attached to the outer surface of the motor housing and extends rearwardly thereof such that in the first position the weight of the workhead assembly (100) is disposed asymmetrically of the pivot axis (117). Brush housing (110) carries two horizontally spaced apart casters (132) which are fastened to a rearwardly facing part of the external surface of the housing (110) such that the said casters are disposed on the same side of the pivot axis (117) as the said counterweight (130).

Figure 4:
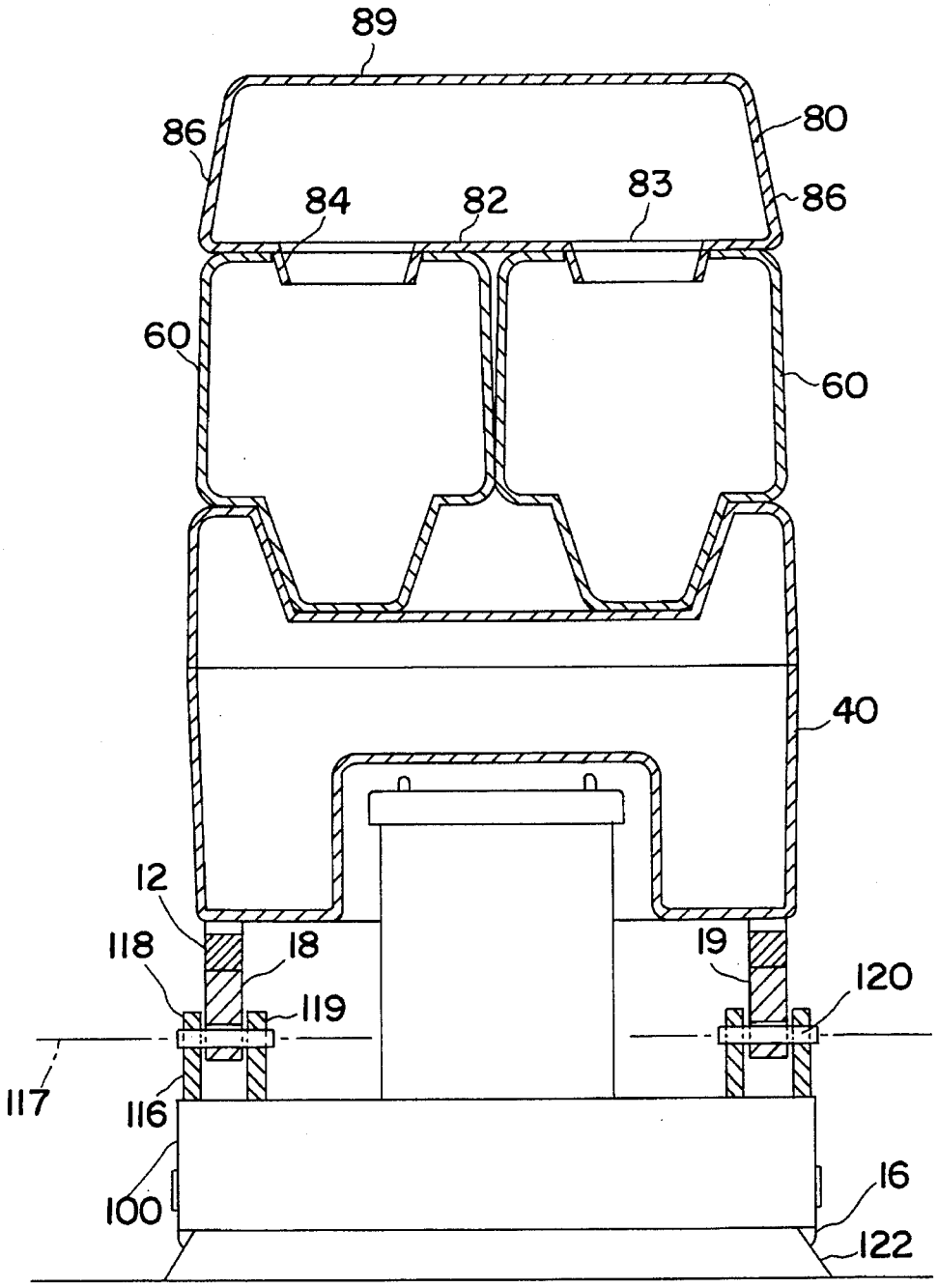
FIG. 4 is a section on the line IV—IV of FIG. 1.

With reference to FIG. 4, annulus (112) is also provided with two mounting brackets (116) for mounting the workhead assembly (100) to the said members (18, 19). Each bracket (116) includes two horizontally spaced apart upstanding plates (118, 119); each plate having a hole (121) formed therein towards its upper end. The said brackets (116) are positioned diametrically opposite one another on the periphery of said annulus (112) and are attached one to each of the said members (18, 19). A portion of each member (18, 19) passes between the plates (118, 119) of its corresponding bracket (116) and a pivot pin (120) extends through the said holes (121) of the bracket (116) and through a hole formed in the members (118, 119) thereby to allow pivotal movement of the workhead assembly (100) about the pivot axis (117).

Figure 2:
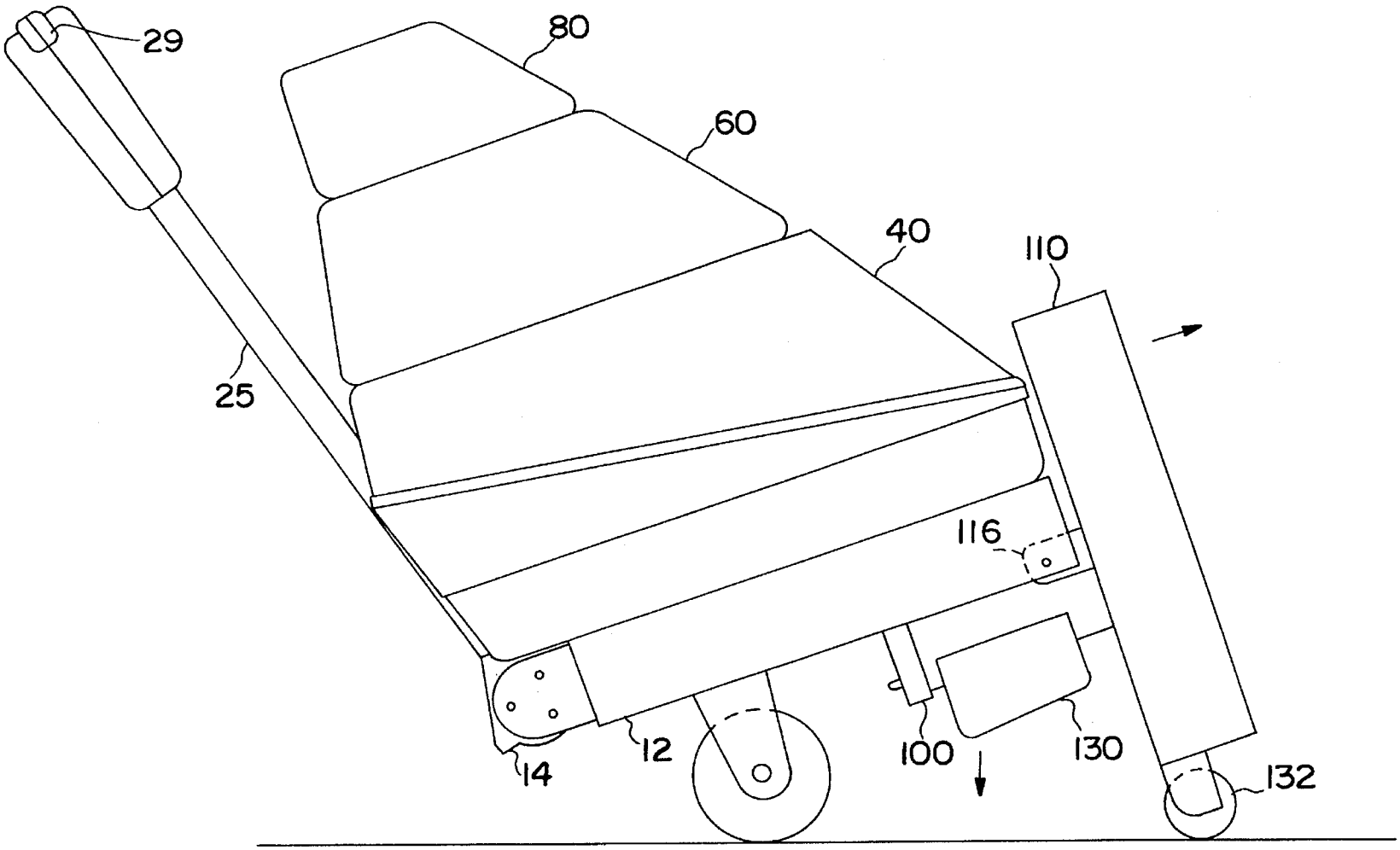
FIG. 2 is a second side view of the machine of FIG. 1.

In FIG. 2, the workhead assembly (100) is shown in a second position in which the workhead assembly (100) is pivotted rearwardly through an angle of about 90° from the said first position such that the brush housing (110) is disposed forwardly of front end (15) of carriage (12), and the motor housing (124) is disposed between the said members (18, 19). The workhead assembly (110) is supported on the said casters (132) which rest on the floor surface forwardly of the pivot axis (117), such that the weight of the machine and the reaction at the casters each act about the pivot to retain the workhead assembly in the second or rest position.

Carriage (12) has a handle (25) attached at the rear end (15) of the former, which handle (25) includes an upwardly and rearwardly extending elongate shaft (27) which has an handle-bar (29) fastened to its upper-end. The shaft (27) can be fixed relative to the carriage (12) so that an operator of the machine can use the handle to rock the carriage (12) backwards on its rear wheels (16) with respect to the floor surface, thereby to raise the front end (15) of the carriage, and to lift the workhead assembly (100) away therefrom. As the machine is so rocked the torque exerted by the weight of the workhead assembly (110) about the pivot axis (117) causes the assembly (100) to rotate towards its second position. In the second position, the casters (132) are disposed forwardly of the pivot axis (117) underneath the brush housing (110), and the front end (15) of the machine is supported thereon.

It will be appreciated that when the workhead assembly of the machine as described herein is positioned in its second rest position the pad or brush unit fastened to the pad holder on the motor shaft is exposed to facilitate maintenance and/or removal and replacement thereof. Moreover, the machine is supported in its second position on the said rear wheels and casters thereby to permit of easy transit of the machine to and away from the floor to be scrubbed or finished.

In particular, it will be appreciated that when the machine as described herein has the workhead assembly in its second rest position, the brush housing extends upwardly and rearwardly from the point of contact between the floor and the said casters.

The upwardly directed reaction exerted on the casters, therefore, exerts a torque about pivot axis (117) which acts to retain the workhead assembly in its rest position as the machine is moved over the floor.

However, the pivot between the workhead assembly and the carriage means may be modified in any manner known to a person skilled in the art to provide a locking or detent means whereby the said assembly is releasably secured in its rest position.

Figure 3:
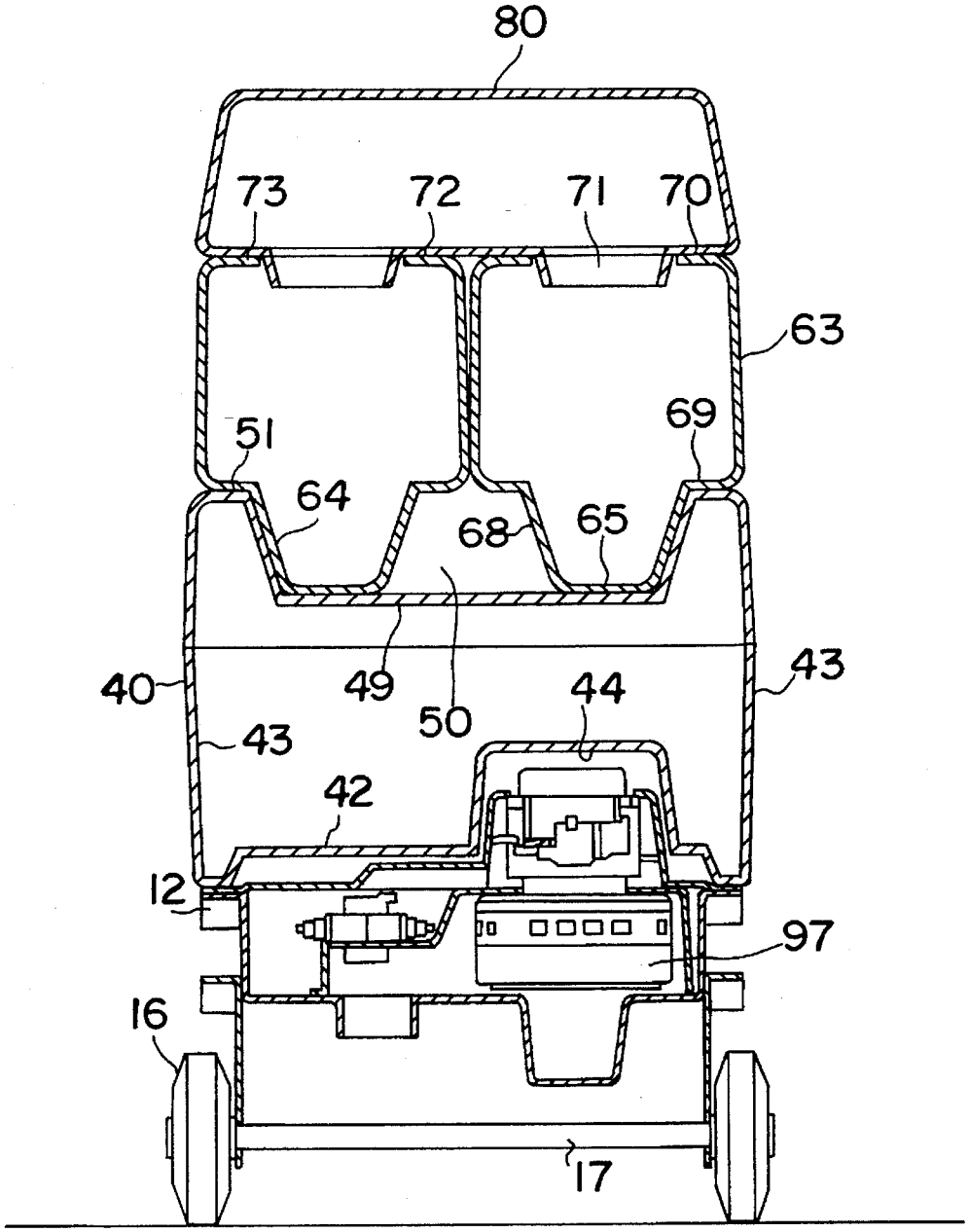
FIG. 3 is a schematic rear view of the machine of FIG. 1.

The floor maintenance machine (10) is provided with fluid handling apparatus for supplying a cleaning solution liquid or polish to the floor to be treated with the pad or brush unit (122). Said apparatus includes a first receptacle (40) which is mounted on said carriage (12) generally over said rear wheels (16). Said first receptacle includes a generally rectangular bottom wall (42) which is shaped towards one side to define upwardly directed recess (44) (see FIG. 3).

Bottom wall (42) is integrally moulded with two upstanding side walls (43), a generally rectangular rear wall (46) and a front wall (45); which front wall (45) is shaped in its lower half to define a rearwardly directed recess which partially accommodates the motor (124) of the workhead assembly (100) when the latter is in its first working position. Said recess (48) has a rear wall (45A) of arcuate cross-section which is shaped to allow unhindered rotation of the workhead assembly (100) about its pivot axis (117). The side (43), front (45) and rear walls (46) are inter connected at their upper ends by a top wall (49) which has a downwardly directed recess (50) formed therein, said recess (50) being generally rectangular in cross-section and defining a peripheral flat-topped ridge (57).

First receptacle (40) also comprises an outlet (not shown) which is formed in the said bottom wall (42) at its lowest point. Said outlet is connected to a conduit which terminates inside brush housing (110) adjacent the pad carrier. First receptacle (40) is also provided with an inlet and a suitable closure therefor.

The said fluid handling apparatus of machine (10) also comprises two second liquid-collecting receptacles (60) which are similar one to the other and are supported sideby-side on the upper wall (49) of said first receptacle. Each second receptacle (60) includes a front wall (61), a rear wall (62), two side walls (63) and a shaped base portion (64). Said base portion (64) includes a narrow bottom wall (65) and front, back and side walls (66), (67) and (68) respectively which each extend upwardly and outwardly to meet the corresponding walls of the second receptacle at an outwardly extending circumferential shoulder (69).

Said front, back and side walls are interconnected at their upper ends by a top wall (70) which has a generally rectangular central opening (71) formed therein and forms an inwardly directed peripheral flange (72) having a smooth upper surface (73). The second receptacles (60) are arranged such that the base portion (64) of each is accommodated within the recess (50) formed in the top wall (49) of the first receptacle (40) and the bottom wall (65) of each is seated thereon; the said shoulder (69) being seated on the said peripheral ridge (51); the second receptacles (60) being configured such that their adjacent inwardly facing side walls (63) are contiguous one another, and the outwardly facing side, front and back walls (64), (66) and (67) of base portion (64) abut on the side walls of recess (50) to form an interference fit therewith.

The second receptacles (60) support a chamber (80) which comprises a generally planar bottom wall (82) which has two generally rectangular apertures (83) formed therein, each aperture (83) being surrounded by a depending peripheral wall (84). Said depending walls (84) extend through the holes (71) formed in the top walls (70) of the second receptacles (60) to form a funnel part (85) therein; the outer surface of each of said funnel parts (85) being contiguous the inner edge of the flange (72) surrounding its corresponding hole (71) to form an air-tight seal therewith. The bottom wall (82) of the chamber (80) is integrally moulded with side wall (86), a front wall (87), a rear wall (88) and a top wall (89). Said rear wall (88) has an aperture (90) formed therein which aperture (90) has a boss (91) fastened thereon. Boss (91) is connected to two flexible vacuum conduits (92, 93).

One of the said conduits (92), which is shown in FIG. 1 comprises two juxtaposed tubes and extends downwardly from said boss (91) and carries at its lower end (93) an elongate nozzle assembly (94) which is oriented transversely of the carriage (12). Said nozzle (94) comprises a depending peripheral skirt (95) which is formed of a plurality of flexible bristles. The nozzle assembly (94) is secured in vertical spaced relationship with the floor by a retainer bar (96) which is fastened at one end to the nozzle (94) and at its other end to the rear end (14) of carriage (12) adjacent the lower end of handle (25); the arrangement being such that the lower ends of the bristles (95) are drawn across the floor as the machine (10) is moved thereover.

Said other conduit (not shown) is connected at its other end to an electrically operated suction pump (97) which is mounted on the carriage (12) above the rear wheels (16) in the recess (44) formed in the bottom of the first receptacle (40).

In use, the first receptacle (40) is filled with a liquid polish or detergent solution, and the machine (10) is moved over the floor on its transit wheels (16) with the workhead assembly (100) in its first working position such that the brush or pad is held in working contact with the floor surface. The liquid solution is dispensed at a predetermined rate from said first receptacle (40) to the floor through its outlet conduit, and the pad or brush unit (122) is driven by the said motor (124) to rotate on the floor thereby to effect polishing or scrubbing thereof.

Suction pump (97) effects a reduced pressure in said chamber (80) and in the said second receptacles (60), which reduction in pressure causes air, liquid and dirt and other dust and detritus at the floor to enter into said conduit (92) at nozzle assembly (94). The liquid slurry is sucked into the nozzle (94) and travels up conduit (92) until it reaches boss (91). The liquid portion and any relatively massive particulate matter then falls under gravity through the chamber (80) and the said funnels (71) into the said second liquid collecting receptacles (60). The air and any relatively less massive detritus entrained therein passes along conduit (95) to the suction pump (97) where it is expelled into the surroundings. The pressure reduction in the said chamber (80) and second receptacles (60) as compared with atmospheric pressure has the advantageous ancilliary effect of effecting a mutual attractive force therebetween, which force urges the bottom wall (82) of the former against the top walls (70) of the latter to reinforce the air-tight seal therebetween.

When the liquid collecting second receptacles (60) are full or nearly full, the suction pump (97) is switched off thereby releasing the attractive force between the chamber (80) and the said second receptacles (60). Chamber (60) can then be removed. The second receptacles (60) can then be removed separately from the first receptacle (40) for emptying and replenishment of the latter.

It will be appreciated that, in a varient of the present invention as described herein, a single liquid collecting receptacle may be substituted for the two separately mounted second receptacles (80), although the latter arrangement described above, by way of example, facilitates the emptying operation since each receptacle will contain only about half the total weight of dirty liquid.

We claim:

1. A machine for cleaning floor surfaces which comprises a carriage adapted for translational movement on a floor surface, a rocking means for rocking said carriage with respect to the floor surface; a workhead assembly mounted on said carriage, a pivot means for allowing said workhead assembly to be movable with respect to the carriage between a first working position and a second rest position, and a bias means acting on said workhead assembly in one of said positions to move the workhead assembly from said one position to the other position; the arrangement being such that rocking said carriage on said rocking means allows the workhead assembly to move under influence of said bias means from said one position to said other position.

2. A machine as claimed in claim 1, in which the workhead assembly includes a motor, a brush housing comprising an annular upper wall and a cylindrical skirt which depends from a periphery of said annular upper wall, and a brush or pad holder arranged for rotation substantially coaxially within the brush housing.

3. A machine as claimed in claim 2, in which the workhead assembly is oriented so that an upper surface of the brush housing is generally horizontal with the workhead in working contact with the floor surface.

4. A machine as claimed in claim 3, in which the upper surface of the brush housing is provided with said pivot means for pivoting the workhead assembly relative to the carriage, said pivot means includes two spaced upstanding brackets secured to said upper surface towards the periphery thereof, the brackets being arranged diametrically opposed one another so that a through bore in each bracket defines said pivot axis.

5. A machine as claimed in claim 4, in which the carriage comprises two spaced chassis members each carrying said pivot means for the workhead assembly and further said upstanding brackets on the brush housing are attached one each to an arm on a horizontal axis generally transverse a fore-aft direction of the carriage such that the workhead assembly can pivot between said work position and said rest position in which in said rest position the workhead assembly is disposed forwardly of said carriage.

6. A machine as claimed in claim 2, in which rocking of the carriage on the rocking means allows the workhead assembly to move under the influence of said bias means from said work position to said rest position in which said workhead assembly is supported on a roller means on the brush housing.

7. A machine as claimed in claim 1, in which the weight of the workhead assembly is distributed asymmetrically of the pivot means when the workhead assembly is in said one position, to provide said bias means, the arrangement being such that rocking the carriage on said rocking means allows the workhead assembly to move from said one position to the other under the influence of gravity.

8. A machine as claimed in claim 1, in which the workhead assembly includes support means for supporting the workhead assembly in the rest position, and said support means comprises one or more castors or rollers arranged to contact the floor surface when said workhead assembly is in the rest position.

9. A machine as claimed in claim 1, in which said carriage has rear wheels which constitute the rocking means, the carriage is capable of being rocked forwards and backwards on said rear wheels, and includes a handle which is used to effect rocking of the carriage with respect to a floor surface.

10. A machine as claimed in claim 1, in which the bias means acts to move the workhead assembly from said one position to said other position and the workhead assembly is disposed over-center with respect to a pivot axis and a point of contact between a roller means and the floor surface, whereby a reaction at the said roller means exerts a moment of force about the said axis which serves to maintain the workhead assembly in said other position thereby permitting the machine to be transported over a floor surface with said workhead assembly out of contact with said floor surface.

11. A machine as claimed in claim 1, in which the workhead assembly comprises a counterweight offset from the pivot axis whereby, in a work position, the weight of the workhead assembly is distributed asymmetrically with respect to the pivot axis, the arrangement being such that when the machine is rocked backwards on its rear wheels, the counterweight causes the workhead assembly to pivot about said pivot axis from said work position to said rest position.

* * * * *